US009938744B2

(12) United States Patent
Gopalan et al.

(10) Patent No.: US 9,938,744 B2
(45) Date of Patent: Apr. 10, 2018

(54) FREE SPINNING SWEEP TAIL SCRUBBER FOR A POOL CLEANER

(71) Applicants: Suresh C. Gopalan, Cary, NC (US); Jayamurali Kaladharan, Tamil Nadu (IN); Adam Key, Raleigh, NC (US); Narender Sanwal, New Delhi (IN)

(72) Inventors: Suresh C. Gopalan, Cary, NC (US); Jayamurali Kaladharan, Tamil Nadu (IN); Adam Key, Raleigh, NC (US); Narender Sanwal, New Delhi (IN)

(73) Assignee: Pentair Water Pool and Spa, Inc., Cary, NC (US)

( * ) Notice: Subject to any disclaimer, the term of this patent is extended or adjusted under 35 U.S.C. 154(b) by 795 days.

(21) Appl. No.: 13/669,241

(22) Filed: Nov. 5, 2012

(65) Prior Publication Data

US 2014/0124423 A1 May 8, 2014

(51) Int. Cl.
*E04H 4/16* (2006.01)

(52) U.S. Cl.
CPC ..... *E04H 4/1681* (2013.01); *E04H 4/1654* (2013.01)

(58) Field of Classification Search
CPC ... E04H 4/1645; E04H 4/1654; E04H 4/1672; E04H 4/1681; B05B 1/1672; B08B 9/0495; F16L 27/125; Y10T 24/3428
See application file for complete search history.

(56) References Cited

U.S. PATENT DOCUMENTS 2,982,971 A 5/1961 Garaway
3,512,540 A 5/1970 Hughes
3,577,571 A 5/1971 Bellinson et al.
3,776,464 A 12/1973 Proffit
3,820,172 A 6/1974 Kane
3,872,533 A * 3/1975 Proffit ..... B05B 3/0427 134/167 R
4,178,949 A * 12/1979 Mazon, III ..... E04H 4/1681 134/167 R
4,282,893 A 8/1981 Kane
4,356,582 A 11/1982 Stephenson
4,651,377 A 3/1987 Staples
(Continued)

FOREIGN PATENT DOCUMENTS

CN 101725262 A 6/2010
DE 201 00 947 U1 5/2001
WO WO 9724053 A1 * 7/1997 ..... A47K 7/02

OTHER PUBLICATIONS

Polaris 3900 Owner's Manual (2008), 12 pages.*
(Continued)

*Primary Examiner* — Patrick Orme
(74) *Attorney, Agent, or Firm* — Quarles & Brady LLP

(57) ABSTRACT

Embodiments of the invention provide a sweep tail for a pool cleaner including a hose, a connector coupled to a first end of the hose and connecting the hose to the pool cleaner, and a scrubber coupled to the hose near a second end of the hose. The scrubber can include a first bearing coupled to and positioned around the hose, a second bearing positioned around the first bearing, and a scrubbing element positioned around the second bearing. The second bearing is capable of rotating around the first bearing and the scrubbing element is capable of rotating with the second bearing around the first bearing.

19 Claims, 5 Drawing Sheets

(56) References Cited

U.S. PATENT DOCUMENTS

| | | | | |
|---|---|---|---|---|
| 5,093,950 | A * | 3/1992 | Heier | 15/1.7 |
| 5,383,975 | A | 1/1995 | Faxon | |
| 5,901,906 | A * | 5/1999 | Bouldin | 239/229 |
| 6,119,707 | A * | 9/2000 | Jordan | 134/93 |
| 6,279,961 | B1 | 8/2001 | Stoltz | |
| 7,721,370 | B2 | 5/2010 | Gopalan | |
| 2010/0011521 | A1 | 1/2010 | Collins | |
| 2012/0255579 | A1* | 10/2012 | Bloink et al. | 134/18 |

OTHER PUBLICATIONS

American Heritage Dictionary Definition, 2016, 3 pages.*
Dictionary.com Definition, 2016, 6 pages.*
MacMillan American English Dictionary Definition, 2016, 4 pages.*
Zodiak Pool Systems, Inc.; "Polaris 3900 Owner's Manual;" pp. 1-12; Sep. 2008; Vista, CA USA.

* cited by examiner

FREE SPINNING SWEEP TAIL SCRUBBER FOR A POOL CLEANER

BACKGROUND

Automatic swimming pool cleaners include components for driving the pool cleaners along the floor and sidewalls of a swimming pool, for scrubbing the floor and sidewalls, and for vacuuming debris near the floor and sidewalls. Conventional pressure side cleaners often include sweep tails positioned at the back of the cleaners that whip around in the water behind the cleaners, agitating debris and helping scrub the pool floor and sidewalls. The sweep tails include scrubbers or brushes positioned at their free end. Each scrubber, usually constructed of sponge-like material, is cylindrical in shape and is coupled to a hose of the sweep tail by either sliding the scrubber over the hose or splitting the scrubber along a seam so that the scrubber can be pressed around the hose. These coupling techniques result in the scrubber being stationary or substantially non-rotatable around the hose. As a result, scrubbers tend to wear unevenly and require replacement or manual repositioning when only a portion of the scrubbers are worn down.

SUMMARY

Some embodiments of the invention provide a sweep tail for a pool cleaner including a hose, a connector coupled to a first end of the hose and connecting the hose to the pool cleaner, and a scrubber coupled to the hose near a second end of the hose. The scrubber can include a first bearing coupled to and positioned around the hose, a second bearing positioned around the first bearing, and a scrubbing element positioned around the second bearing. The second bearing is capable of rotating around the first bearing and the scrubbing element is capable of rotating with the second bearing around the first bearing.

Some embodiments of the invention provide a scrubber for a pool cleaner sweep tail including a first bearing, a second bearing, and a scrubbing element. The first bearing is capable of being coupled to and positioned around an outer diameter of the sweep tail. The second bearing is positioned around the first bearing and is capable of rotating around the first bearing. The scrubbing element is positioned around the second bearing and is capable of rotating around the first bearing with the second bearing.

DETAILED DESCRIPTION

Figure 1:
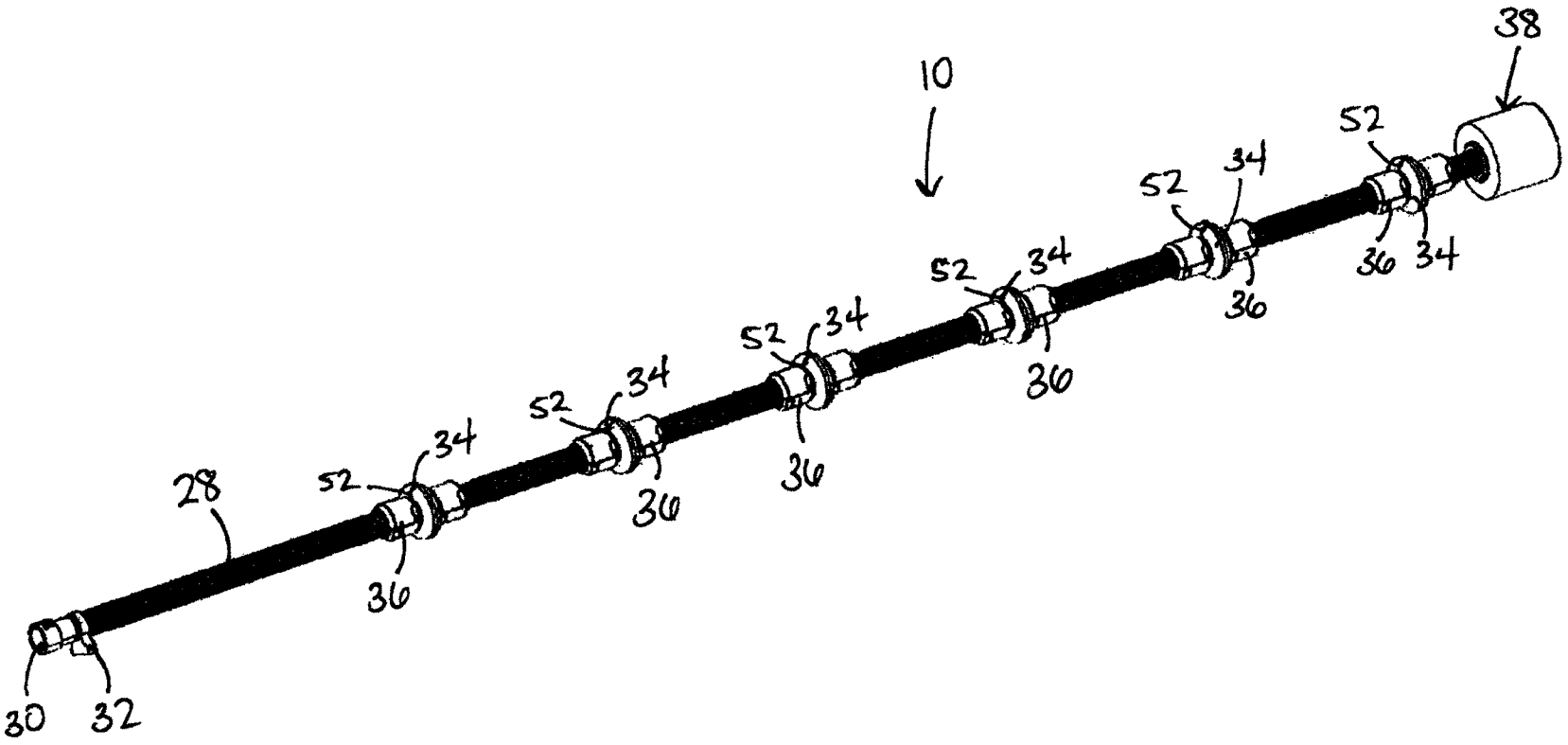
FIG. 1 is a perspective view of a sweep tail according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
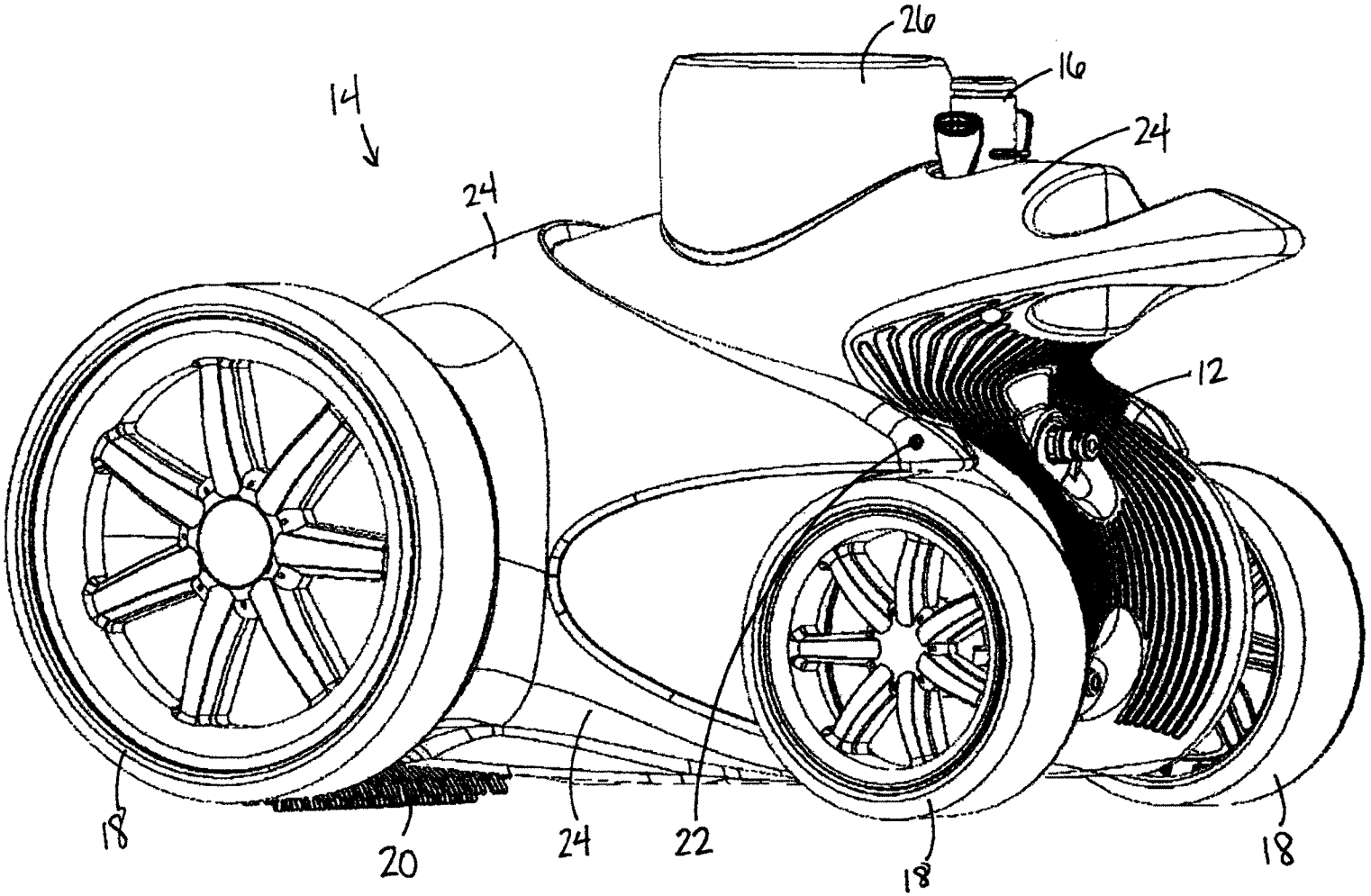
FIG. 2 is a rear perspective view of a pool cleaner for use with the sweep tail of FIG. 1.

FIG. 1 illustrates a sweep tail 10 according to one embodiment of the invention. The sweep tail 10 can be coupled to a sweep tail jet 12 of a pool cleaner 14, as shown in FIG. 2, and can assist in scrubbing a swimming pool or spa floor and walls (i.e., pool surfaces) during operation of the pool cleaner 14. More specifically, during operation of the pool cleaner 14, the sweep tail 10 can receive pressurized water from the sweep tail jet 12, causing the sweep tail 10 to whip around in a sweeping motion behind the pool cleaner 14, scrubbing and agitating debris on the pool surfaces.

In some embodiments, the pool cleaner 14, a shown in FIG. 2, can be a pressure-side pool cleaner. The pool cleaner 14 can received pressurized water pumped through a hose (not shown), for example by a filtration system pump of the pool, into a supply mast 16 of the pool cleaner 14. The water entering the supply mast 16 can be redirected toward different components of the pool cleaner 14 to rotate one or more pool cleaner wheels 18 to drive the pool cleaner 14, rotate a front surface scrubber 20 to scrub pool surfaces and agitate debris on the pool surfaces, provide propulsion via directional jets 22 along one or more outer covers 24 to change direction of the pool cleaner 14, vacuum debris on and around the pool surfaces into a supply mast 26 to collect the debris in a connected debris collection bag or container (not shown), and/or to whip the sweep tail 10 around behind the pool cleaner 14 to further agitate debris and scrub pool surfaces.

Figure 3:
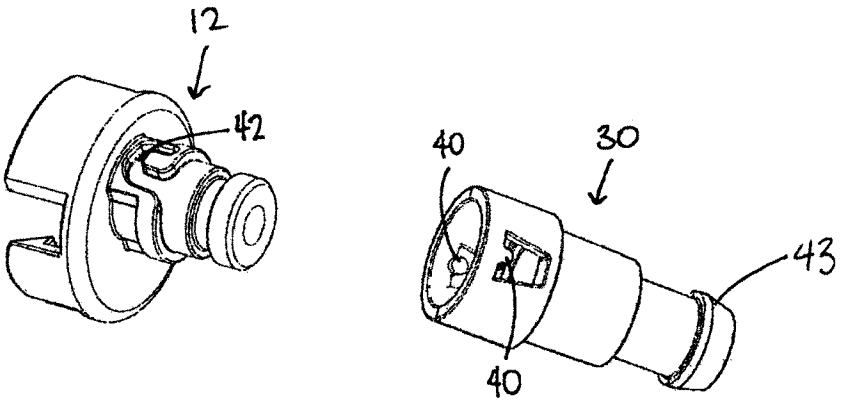
FIG. 3 is an exploded perspective view of a pool cleaner sweep tail jet and a sweep tail connector, according to one embodiment of the invention.

As shown in FIG. 1, the sweep tail 10 can include a hose 28, a connector 30, a stop 32, a plurality of wear rings 34 and wear ring bearings 36, and a scrubber 38. The connector 30 can be used to couple the sweep tail 10 to the sweep tail jet 12 of the pool cleaner 14, for example with a twist and lock type connection. More specifically, as shown in FIG. 3, the connector 30 can be pressed onto the sweep tail jet 12 to engage a pin 40 on the connector 30 with a track 42 on the sweep tail jet 12. The connector 30 can be twisted so that the pin 40 follows the track 42 and locks together the connector 30 and the sweep tail jet 12. This locking connection prevents disengagement of the connector 30 from the sweep tail jet 12 when the connector 30 is pulled directly outward away from the sweep tail jet 12. Rather, the connector 30 must be twisted so that the pin 40 follows the track 42 until it reaches an unlocked position where the connector 30 can be freely pulled away from the sweep tail jet 12.

The stop 32 can be positioned over the hose 28 near the connector 30, as shown in FIG. 1. The stop 32 can be shaped to allow some rotation of the hose 28, and thus, of the connector 30 on the sweep tail jet 12, but the stop 32 can prevent rotation that would allow the pin 40 to disengage from the track 42 and disconnect the sweep tail 10 from the pool cleaner 14. For example, the stop 32 can be shaped to engage the pool cleaner outer covers 24 when the hose 28 rotates too far in either direction and, as a result, can prevent the hose 28 from further rotation that would cause disengagement of the sweep tail 10 from the pool cleaner 14.

Figure 4A:
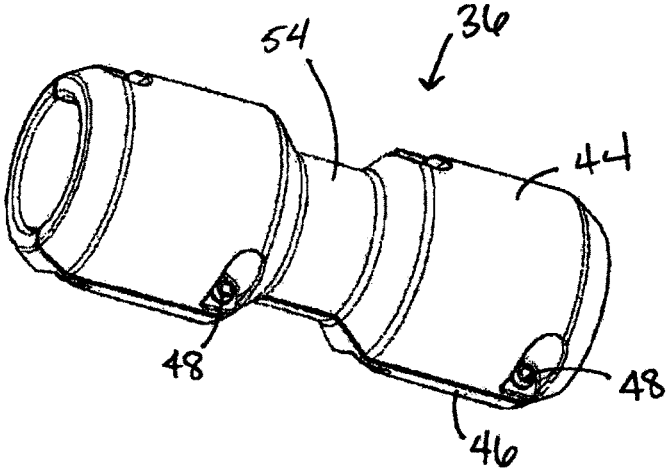
FIG. 4A is a perspective view of a wear ring bearing for use with the sweep tail of FIG. 1.
Figure 4B:
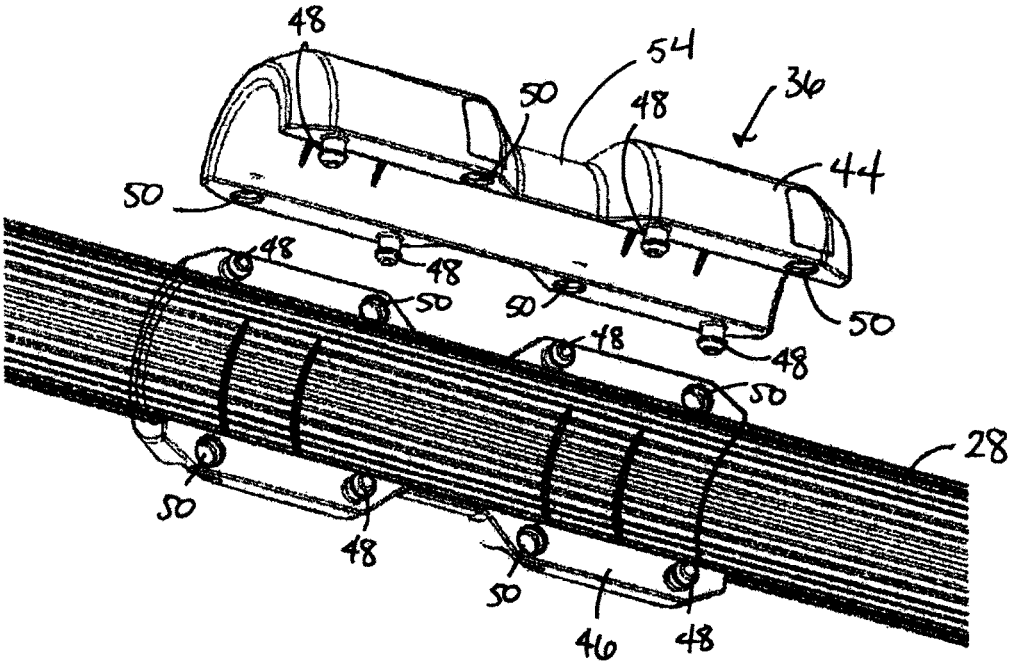
FIG. 4B is an exploded perspective view of a wear ring bearing and a hose of the sweep tail of FIG. 1.

The hose 28 can extend from the connector 30 and can be coupled to the connecter 30 by a press-fit connection (e.g., the connector 30 can be pressed into the hose 28 and one or more angled ribs 43 of the connector 30, as shown in FIG. 3, can prevent disengagement between the hose 28 and the connector 30). The hose 28 can be constructed of flexible material so that water forced from the sweep tail jet 12 through the connector 30 and the hose 28 causes the hose 28 to whip around. The wear rings 34 can be positioned along the length of the hose 28 to prevent wear on the hose 28 caused by whipping against pool surfaces. The wear rings 34 can be positioned over wear ring bearings 36 that are, in some embodiments, snapped onto the hose 28. For example, as shown in FIGS. 4A and 4B, the wear ring bearings 34 can be constructed of a first piece 44 and a second piece 46 snapped together over the hose 28. Each piece 44, 46 can include protrusions 48 and recesses 50 positioned so that, when the two pieces 44, 46 are pressed together over the hose 28, each protrusion 48 can snap into a respective recess 50. An inner diameter of the wear ring bearings 36 can be the same or slightly smaller than an outer diameter of the hose 28 so that the wear ring bearings 36 are substantially locked in position when snapped over the hose 28 (i.e., so that they do not easily slide along the hose 28). In other embodiments, the wear ring bearings 36 can include other coupling elements or can be one-piece assemblies slidable over the hose 28. The wear ring bearing 34 can be substantially flexible rings with a slit or seam 52, as shown in FIG. 1. Each wear ring bearing 34 can be manually flexed so that the slit 52 is large enough to allow the wear ring bearing 34 to be slid over a respective indented portion 54 of the wear ring bearing 36 for placement. Each wear ring bearing 34 can be maintained within a respective indented portion 54 until a user manual flexes the wear ring bearing 34 so that it can be slid out of the indented portion 54 for removal or replacement.

Figure 5:
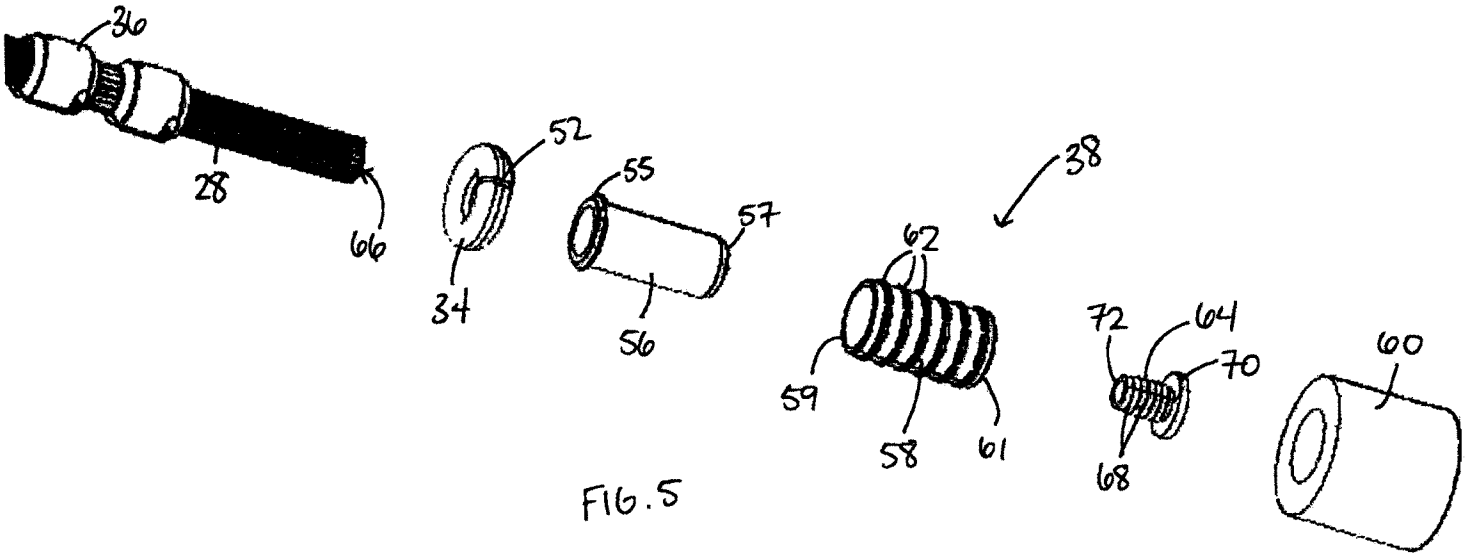
FIG. 5 is a partial exploded perspective view of the sweep tail of FIG. 1.
Figure 6:
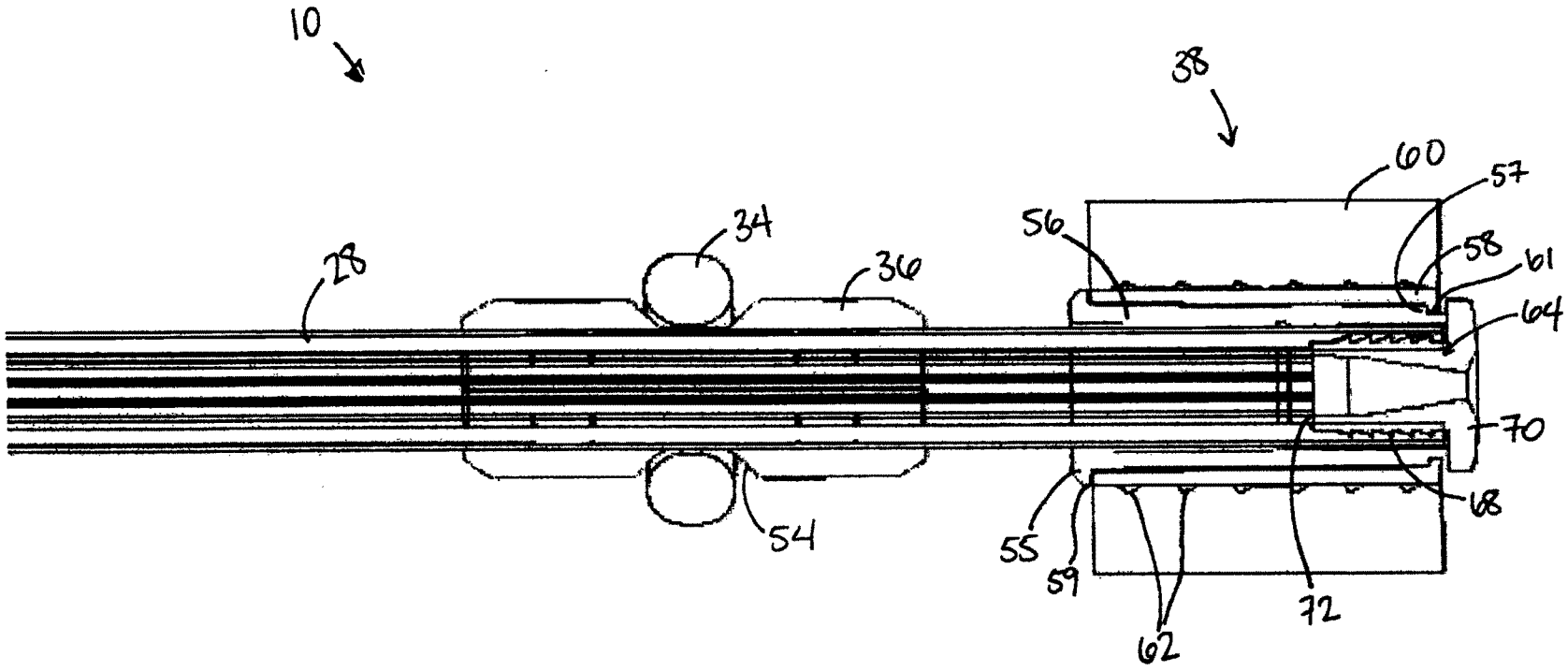
FIG. 6 is a partial cross-sectional view of the sweep tail of FIG. 1.

As shown in FIGS. 1, 5, and 6, the scrubber 38 can be positioned at or near the free end of the hose 28 and can include a first bearing 56, a second bearing 58, and a scrubbing element 60. The scrubbing element 60 can be constructed of a sponge-like material, such as polyvinyl alcohol (PVA) or another suitable material, and can be used to scrub pool surfaces when the sweep tail 10 is whipped around by the pool cleaner 14. The first bearing 56 can be positioned around the hose 28, and can include an inner diameter substantially equal to the outer diameter of the hose 28 to allow a press fit connection. The second bearing 58 can be positioned around the first bearing 56 and can include an inner diameter substantially equal to or slightly larger than an outer diameter of the first bearing 56. The first bearing 56 can be substantially fixed in positioned and stationary, while the second bearing 58 can be rotatable about the first bearing 56. As shown in FIG. 6, the first bearing 56 can include a front lip 55 and a rear shoulder 57. When the second bearing 58 is positioned over the first bearing 56, the front lip 55, which can contact a front edge 59 of the second bearing 58, and the rear shoulder 57, which can contact a rear lip 61 of the second bearing 58, can help maintain the second bearing 58 in place while still allowing the second bearing 58 to rotate around the first bearing 56. At least the second bearing 58 can be constructed of a plastic resin to facilitate easy rotation around the first bearing 56.

The scrubbing element 60 can include an inner diameter substantially equal to an outer diameter of the second bearing 58 so that the scrubbing element 60 can be slid over the second bearing 58. The scrubbing element 60 can be held in place by ribs 62 on the second bearing 58, allowing the scrubbing element 60 to rotate with the second bearing 58 around the first bearing 56. As a result, the scrubbing element 60 can spin freely as the hose 28 whips or sweeps back and forth. The scrubbing element 60 can scrub surfaces of the pool and/or help agitate dirt and debris in the water as the hose 28 sweeps back and forth. The ability for the scrubbing element 60 to spin freely allows more even wear of the scrubbing element 60 (i.e., due to scrubbing action against pool surfaces) as well as reduced drag of the hose 28 as it whips back and forth in comparison to conventional stationary scrubbers or brushes. In addition, in some embodiments, the sweep hose 10 can include additional scrubbers 60 positioned along the length of the hose 28 or near the end of the hose 28.

FIGS. 5 and 6 also show an end tail jet 64 positioned at the end of the hose 28 and coupled to the end of the hose 28 by a press-fit connection. More specifically, the end tail jet 64 can be inserted into an end opening 66 of the hose 28 and angled ribs 68 on the end tail jet 64 can prevent the end tail jet 64 from sliding out of the end opening 66. The end tail jet 64 can include an outer end stop portion 70 that extends past the outer diameters of the hose 28 and the first bearing 56 and the inner diameter of the second bearing 58 to prevent the second bearing 58 from sliding off the first bearing 56 and the first bearing 56 from sliding off the hose 28. The second bearing 58 can therefore be maintained between the outer end stop portion 70 of the end tail jet 64 and the front lip 55 of the first bearing 56 (e.g., which can have a diameter larger than the inner diameter of the second bearing 58), yet is still free to rotate around the first bearing 56. To remove the second bearing 58 and/or the first bearing 56, the end tail jet 64 can be pulled out of the hose 28, the second bearing 58 can be slid off the first bearing 56, and the first bearing 56 can be pulled off the hose 28.

The end tail jet 64 can also increase the velocity of the water exiting the hose 28, facilitating the whipping motion of the sweep hose 10. As shown in FIG. 6, the inner diameter of the end tail jet 64 decreases from a front portion 72 toward the outer end stop portion 70. This converging diameter restricts fluid flow and, as a result, increases the velocity of the water exiting the hose 28.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A sweep tail for a pool cleaner, the sweep tail comprising:

a hose;

a connector coupled to a first end of the hose and connecting the hose to the pool cleaner; and a scrubber coupled to the hose at a second end of the hose, the scrubber including a first bearing coupled to and positioned around the hose, a second bearing positioned substantially around the entire first bearing, the second bearing capable of rotating around the first bearing, a scrubbing element positioned around, and slid over the entire second bearing and capable of rotating with the second bearing around the first bearing and an end tail jet positioned at the second end of the hose, the end tail jet including a passage having an inner diameter that decreases from a front end to a rear end of the end tail jet.

2. The sweep tail of claim 1, wherein the second bearing includes ribs that hold the scrubbing element around the second bearing.

3. The sweep tail of claim 1, wherein the first bearing is coupled to the hose at least by a press fit connection.

4. The sweep tail of claim 1, wherein the scrubbing element is a polyvinyl alcohol sponge.

5. The sweep tail of claim 1 and further comprising a second scrubber coupled to the hose at the second end of the hose.

6. The sweep tail of claim 1 wherein the end tail jet prevents the first bearing from sliding off the second end of the hose.

7. The sweep tail of claim 6, wherein the end tail jet includes an end stop portion and the first bearing includes a front lip portion, wherein the second bearing is maintained over the first bearing between the front lip portion and the end stop portion.

8. The sweep tail of claim 6, wherein the end tail jet includes angled ribs and the end tail jet is coupled to an inner diameter of the hose by the angled ribs.

9. The sweep tail of claim 1 and further comprising at least one wear ring bearing positioned around the hose and at least one wear ring positioned around the at least one wear ring bearing.

10. The sweep tail of claim 9, wherein the at least one wear ring bearing includes two pieces snapped together over the hose.

11. The sweep tail of claim 1, wherein the connector includes at least one pin capable of engaging a track on the pool cleaner to couple the hose to the pool cleaner.

12. The sweep tail of claim 1 further comprising a second scrubber coupled to the hose.

13. A scrubber for a pool cleaner sweep tail, the scrubber including:

a first bearing having an outwardly extending front lip and a rear shoulder, the first bearing coupled to and positioned around an outer diameter of the sweep tail at an end of a hose;

a second bearing having an inwardly extending rear lip, the second bearing positioned around the first bearing, the second bearing capable of rotating around the first bearing; and a scrubbing element positioned around the second bearing and capable of rotating with the second bearing around the first bearing, wherein the inwardly extending rear lip of the second bearing engages the rear shoulder of the first bearing to prevent the second bearing from sliding off the first bearing while allowing the second bearing to rotate around the first bearing and the outwardly extending front lip also prevents the second bearing from sliding off the first bearing while allowing the second bearing to rotate around the first bearing.

14. The scrubber of claim 13, wherein the second bearing includes ribs that extend outwardly into the scrubbing element to hold the scrubbing element around the second bearing.

15. The scrubber of claim 13, wherein the scrubbing element is a polyvinyl alcohol sponge.

16. The scrubber of claim 13 and further comprising an end tail jet coupled to the sweep tail, wherein the front lip and the end tail jet also prevent the second bearing from sliding off the first bearing.

17. The scrubber of claim 13, wherein the second bearing is constructed of a resin material.

18. The scrubber of claim 13, wherein the scrubbing element includes an inner diameter substantially equal to an outer diameter of the second bearing.

19. The scrubber of claim 13, wherein the first bearing is fixed in place around the outer diameter of the sweep tail.

* * * * *